US008348288B1

(12) United States Patent
Laughon, Sr.

(10) Patent No.: US 8,348,288 B1
(45) Date of Patent: Jan. 8, 2013

(54) KNEE SCOOTER

(75) Inventor: Thomas C. Laughon, Sr., Greensboro, NC (US)

(73) Assignee: Design Source Limited Properties, LLC, Greensboro, NC (US)

( * ) Notice: Subject to any disclaimer, the term of this patent is extended or adjusted under 35 U.S.C. 154(b) by 306 days.

(21) Appl. No.: 12/793,715

(22) Filed: Jun. 4, 2010

(51) Int. Cl.
*A61G 5/02* (2006.01)

(52) U.S. Cl. ..... 280/87.021; 280/87.05

(58) Field of Classification Search ..... 280/87.021, 280/87.05
See application file for complete search history.

(56) References Cited

U.S. PATENT DOCUMENTS

| | | | | |
|---|---|---|---|---|
| 4,722,356 | A | 2/1988 | Rehder | 135/67 |
| 4,890,853 | A | 1/1990 | Olson | 280/87.021 |
| 5,086,798 | A | 2/1992 | Motts | 135/67 |
| 5,167,597 | A | 12/1992 | David | 482/68 |
| D362,506 | S | 9/1995 | Bieri | D24/190 |
| 5,746,236 | A | 5/1998 | Tilsley et al. | 135/66 |
| 5,800,317 | A | 9/1998 | Accetta | 482/66 |
| 5,839,740 | A * | 11/1998 | Seeger | 280/87.021 |
| 6,634,660 | B2 * | 10/2003 | Miller | 280/87.021 |
| 7,293,827 | B2 | 11/2007 | Schrader | 297/195.11 |
| 7,988,163 | B2 * | 8/2011 | Accetta | 280/87.05 |
| 7,997,597 | B2 * | 8/2011 | Mehl | 280/87.021 |
| 2004/0201192 | A1 * | 10/2004 | Ramm | 280/87.021 |
| 2004/0217565 | A1 | 11/2004 | Ramm | 280/87.01 |
| 2005/0279392 | A1 | 12/2005 | Lapierre | 135/68 |
| 2006/0033297 | A1 | 2/2006 | Miller | 280/87.021 |
| 2007/0182116 | A1 * | 8/2007 | Davey et al. | 280/87.05 |
| 2008/0284125 | A1 * | 11/2008 | Ramm et al. | 280/263 |
| 2009/0058036 | A1 * | 3/2009 | Hoepner et al. | 280/267 |
| 2009/0152829 | A1 * | 6/2009 | Anderson | 280/278 |

OTHER PUBLICATIONS

Four page printout from cgi.ebay.com showing "Turning Steerable Rolling Knee Walker Scooter Leg Caddy" of Wheelchairs Plus Mobility Solutions, LLC; undated Apr. 22, 2010.
One page printout from andrewstreet.com showing "Weil Knee Walker" Medline; undated Apr. 22, 2010.
One page printout from invacare.com showing "Knee Walker"; undated Apr. 22, 2010.
One page printout from xsmedical.com showing "Nova Knee Cruiser"; undated Apr. 22, 2010.
One page printout from xsmedical.com showing "Kneal Knee Cruiser Knee Walker" by Vergon; undated Apr. 22, 2010.
One page printout from amazon.com showing "Knee Walker-Crutch Alternative Turning Leg Caddy" by Nova Ortho-Med; undated Apr. 22, 2010.
One page printout from andrewstreet.com showing "Dartmouth Knee Walker"from Bantex; undated Apr. 22, 2010.
One page printout from andrewstreet.com showing "Roll-A-Bout Steerable Knee Walker" from Roll-A-Bout; undated Apr. 22, 2010.
One page printout from rammtlc.com showing "Pathfinder Turning Leg Caddy®" by RammTLC,LLC; undated Apr. 22, 2010.
One page printout from spinlife.com showing "Drive Medical NeeBob Steerable Knee Walker"; undated Apr. 22, 2010.

* cited by examiner

*Primary Examiner* — Kevin Hurley
(74) *Attorney, Agent, or Firm* — Walter L. Beavers; Blake P. Hart

(57) ABSTRACT

A knee scooter having pivotable handle bars, a U-shaped frame with a wide rear axle and an adjustable knee support for use by injured or disabled users. The wide rear axle of the U-shaped frame can be laterally moved to accommodate either an injury to a right or left leg. The scooter is steered by turning a pair of front wheels and hand brakes are positioned on the handle bars to manually stop the scooter as needed. The steering or turning of the front wheels is limited to about 60° rotation for safety purposes. The method of use includes securing the handle bars in an upright position, adjusting the steering column height, adjusting the knee support height and moving the rear axle laterally to accommodate supporting either a right or left leg as needed as the other leg is used to propel the scooter.

17 Claims, 10 Drawing Sheets

KNEE SCOOTER

FIELD OF THE INVENTION

The invention herein pertains to a scooter for use by persons with foot, ankle or leg injuries below the knee or ailments and particularly pertains to a knee scooter having an adjustable wide rear axle to accommodate either a left or right knee support.

DESCRIPTION OF THE PRIOR ART AND OBJECTIVES OF THE INVENTION

Knee scooters have become increasingly popular in recent years as canes, crutches and the like have been found inconvenient and unstable for certain persons with leg, foot and ankle injuries or ailments such as arthritis. Such scooters have been proven advantageous to assist in easier and safer mobility and for traveling longer distances. Various types of knee scooters have been developed which have been somewhat beneficial to users, however, certain of the prior scooters have been found to be unstable and can harm the user. Other scooters are suitable for particular individuals but are unsuitable for others due to difficulties in making specific adjustments needed. Scooters that have been manufactured in the past are generally expensive and therefore unavailable to many who can not afford them.

Thus in view of the problems and disadvantages of prior devices, the present invention was conceived and one of its objectives is to provide a knee scooter which is relatively inexpensive to manufacture and purchase.

It is another objective of the present invention to provide a stable knee scooter having a wide rear axle which will accommodate practically all persons having a leg, ankle or foot injury or ailment on only one leg.

It is still another objective of the present invention to provide a knee scooter which is easy to adjust, propel, steer and brake without undue training or experience.

It is yet another objective of the present invention to provide a method for using a knee scooter which allows an individual to make various adjustments depending on their injury or ailment.

It is a further objective of the present invention to provide a knee scooter having a laterally adjustable wide rear axle which affords easy adjustment and use for either a right or left leg injury or ailment and has a limited steering rotation of about 60° for safety purposes.

It is still a further objective of the present invention to provide a knee scooter which includes a steering column which is vertically adjustable and can easily be folded for storage and transportation purposes.

It is yet a further objective of the present invention to provide a knee scooter having a knee support which affords easy vertical adjustment for accommodation of the user's height.

Various other objectives and advantages of the present invention will become apparent to those skilled in the art as a more detailed description is set forth below.

SUMMARY OF THE INVENTION

The aforesaid and other objectives are realized by providing an adjustable knee scooter and method of operation which is easily manipulated and which can be adjusted for a variety of users. The rear axle of the scooter is wide to provide stability and can be moved laterally for propelling the scooter by either a user's left or right leg. This lateral movement allows for a wide rear axle, which with the dual pivotable front wheels provides greater stability, particularly as the scooter is turned, mounted or dismounted.

The steering assembly allows for the handle bars to be pivoted and folded in a downward posture against the knee support when the scooter is stored or transported. For use the handle bars are pivoted to an upright position and locked in place with a clevis and locking knob. The height of the handle bars can be easily varied using a pair of opposing spring loaded projections which are secured in one pair of a plurality of opposing opening pairs along the steering column member. Brake controls on the handle bars allow for easily stopping or slowing down when the scooter is moving. The knee support is comfortable and includes a vinyl covered polyurethane foam cushion having a cushion brace with threaded stud centrally affixed therebeneath for adjusting the height of the knee support from the frame to accommodate the leg length of a specific user. The steering column which is limited in rotation to about 60° for safety is connected to a U-shaped tubular frame and the rear axle is connected to the tubular frame through channels within the rear axle. The channels accommodate either a left or right frame position with the center channel common to both positions.

DETAILED DESCRIPTION OF THE PREFERRED EMBODIMENT AND OPERATION OF THE INVENTION

Figure 1:
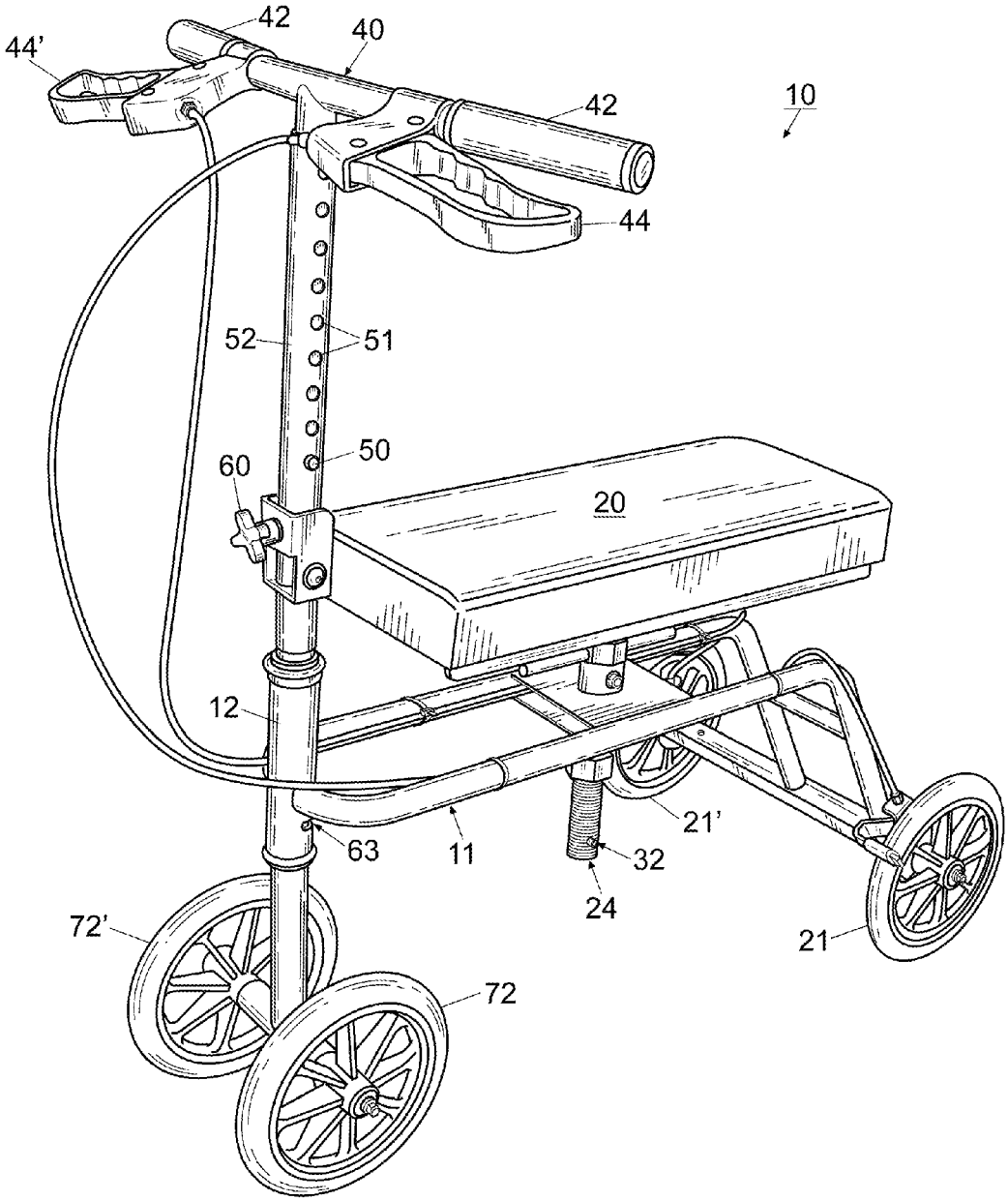
FIG. 1 shows a top, front, right side perspective view of the invention for left leg propulsion.
Figure 2:
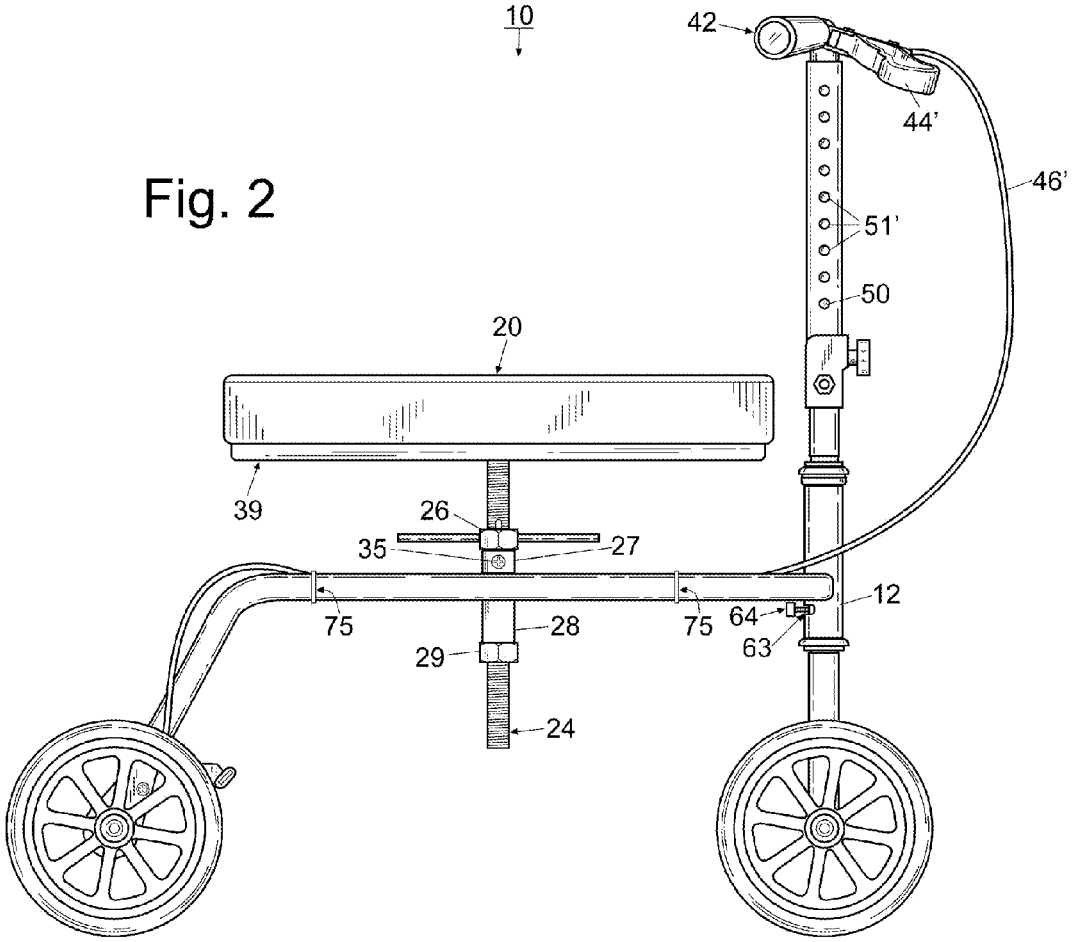
FIG. 2 depicts a left side elevational view of the scooter as shown in FIG. 1.
Figure 3:
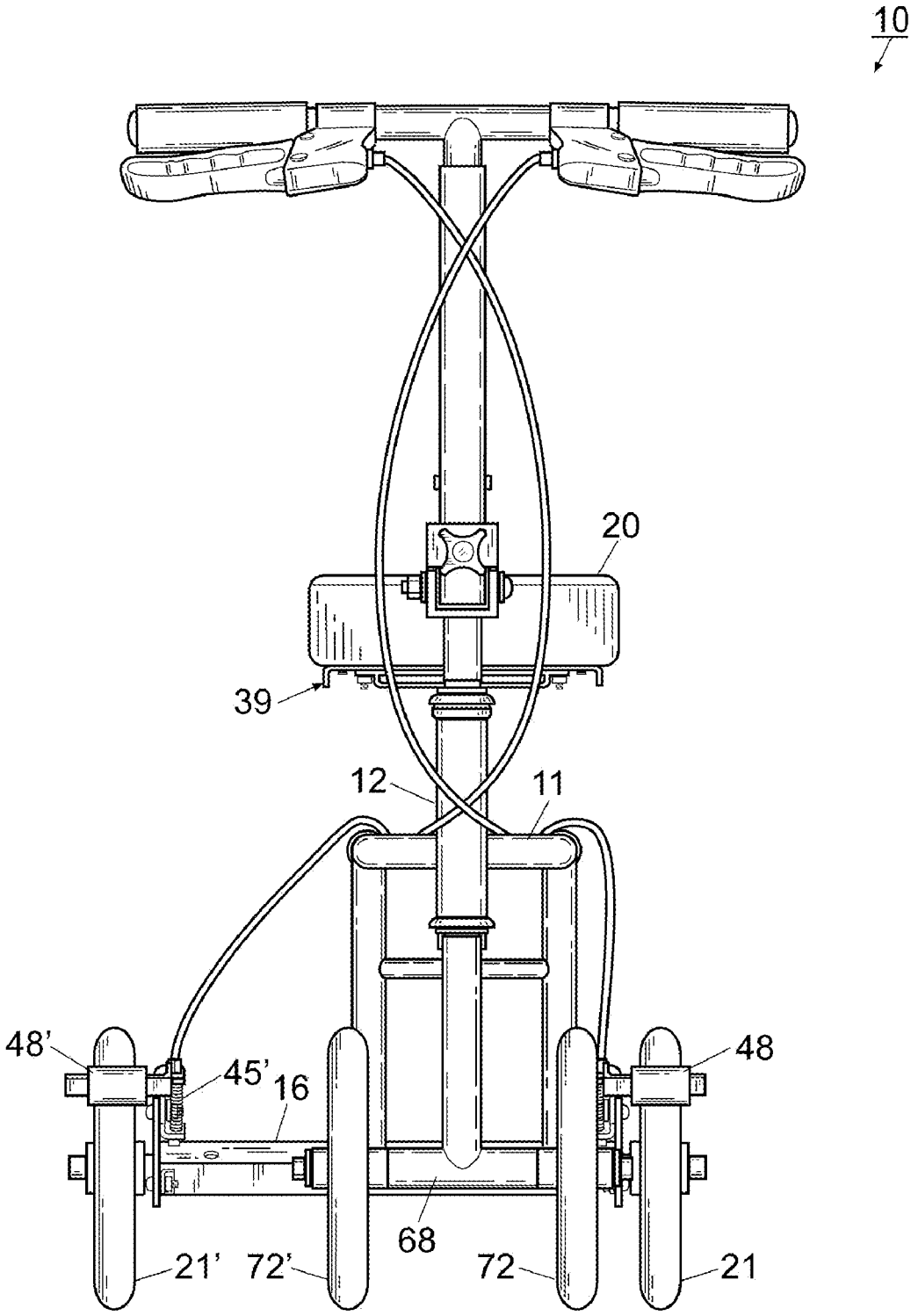
FIG. 3 demonstrates a front elevational view of the scooter as shown in FIG. 1.

For a better understanding of the invention and its operation, turning now to the drawings, preferred knee scooter 10 is shown assembled in FIGS. 1-6 in various views. Knee scooter 10 includes steel tubular frame 11 which is affixed at the front end to sleeve 12 of steering assembly 40 (FIG. 10) such as by welding or the like. Frame 11 is generally U-shaped as also shown in FIG. 8 and horizontally oriented as shown in FIG. 2 but includes a pair of vertically disposed tubular ends 13, 13' for attachment to rear axle 16 having frame support 38 therebetween as also shown in FIGS. 4, 5, 7A and 7B. The horizontal orientation of frame 11 refers to the parallel positioning of frame 11 with knee support 20 where frame 11 is joined with steering assembly 40 when scooter 10 rests on a level surface as shown in FIGS. 2 and 3. Rear axle 16 is wider than front axle 68 as seen in FIG. 3 to provide stability to scooter 10 during motion and includes channels 17, 17' and 17" (FIG. 8) for selectively receiving tubular ends 13, 13' for attachment of frame 11 thereto. Threaded inserts 14, 14' as shown in FIG. 8 are rigidly affixed respectively within tubular ends 13, 13' for receiving respectively, bolts 15, 15' with washers 19, 19' which pass through either channels 17, 17' (FIG. 7A) or 17, 17" (FIG. 7B) selectively for adjusting scooter 10 for supporting a user's knee and propelling by respectively either a user's left or right leg.

Figure 7A:
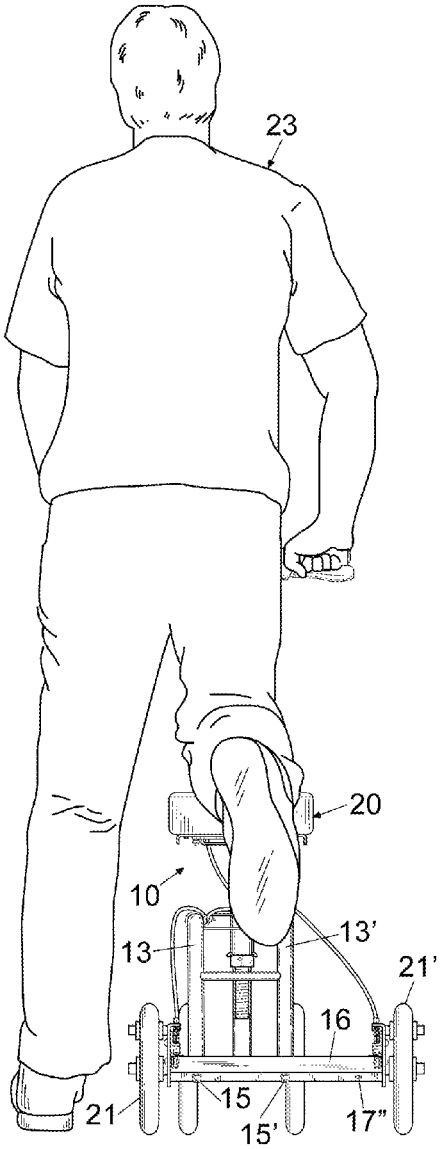
FIG. 7A shows a rear elevational view of the scooter with the rear axle adjusted for right knee support with a user positioned thereon.
Figure 7B:
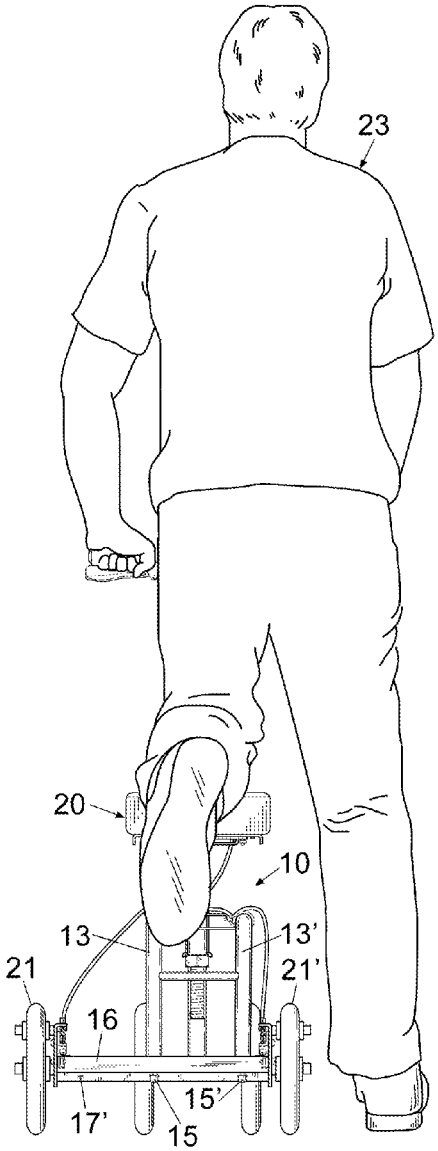
FIG. 7B illustrates the scooter adjusted for left knee support for the user positioned thereon.
Figure 8:
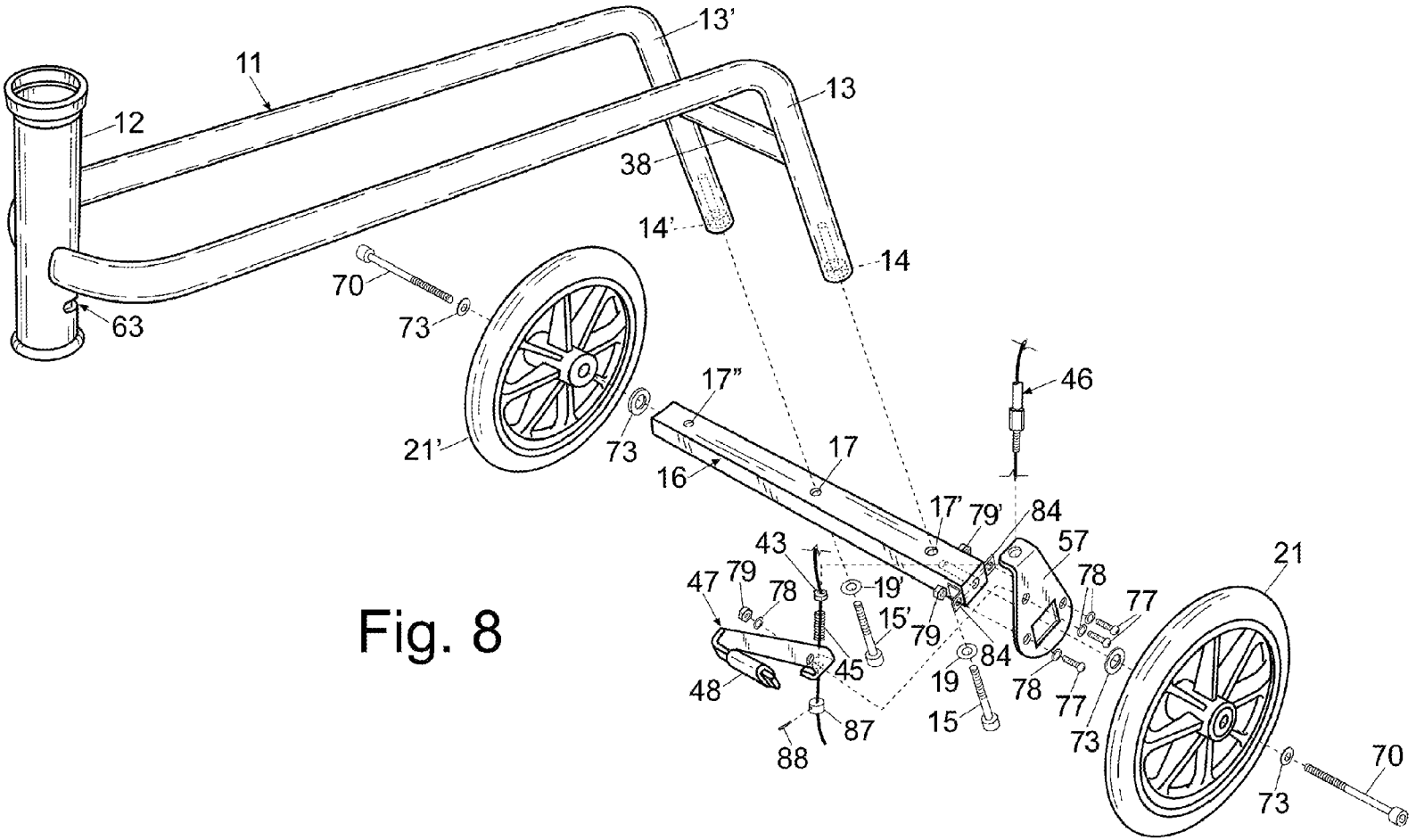
FIG. 8 demonstrates a partial exploded view of the frame and rear axle.

Knee support 20 can support either the right knee or the left knee of user 23 as shown in FIGS. 7A and 7B. When the right knee is supported as shown in FIG. 7A, rear axle 16 is laterally positioned with frame ends 13, 13' positioned respectively for channels 17', 17 whereas for supporting the left knee of user 23 shown in FIG. 7B, frame ends 13, 13' are positioned respectively for channels 17, 17". The lateral shifting of wide rear axle 16 allows user 23 to easily propel knee scooter 10 without interference from rear wheels 21, 21' which helps maintain the stability of scooter 10 during movement, particularly while turning, backing, mounting, dismounting and the like.

As seen in FIG. 8 rear wheels 21, 21' are affixed to wide rear axle 16 by threaded axles 70, 70' which are threadably engaged with rear axle 16 to retain respectively conventional rear wheels 21, 21' thereon. Conventional washers 73 are utilized on each side of rear wheels 21, 21' to insure smooth operation and rotation. As further shown rear axle 16 includes L-shaped brackets 84 affixed to each side for receiving and affixing brake housing 57 thereto by conventional bolts 77, washers 78 and nuts 79. Brake housing 57 includes an aperture (not shown) for receiving brake cable 46 which joins to conventional nut 43, spring 45 and brake arm 47 and includes cable stop end 87 with stop lock 88 as is standard for use of conventional brakes 44, 44'. As would be understood for clarity only one side, brake 44 is illustrated in FIG. 8 and the opposing side, brake 44' includes the same parts and is connected the same way for operation thereof.

Figure 4:
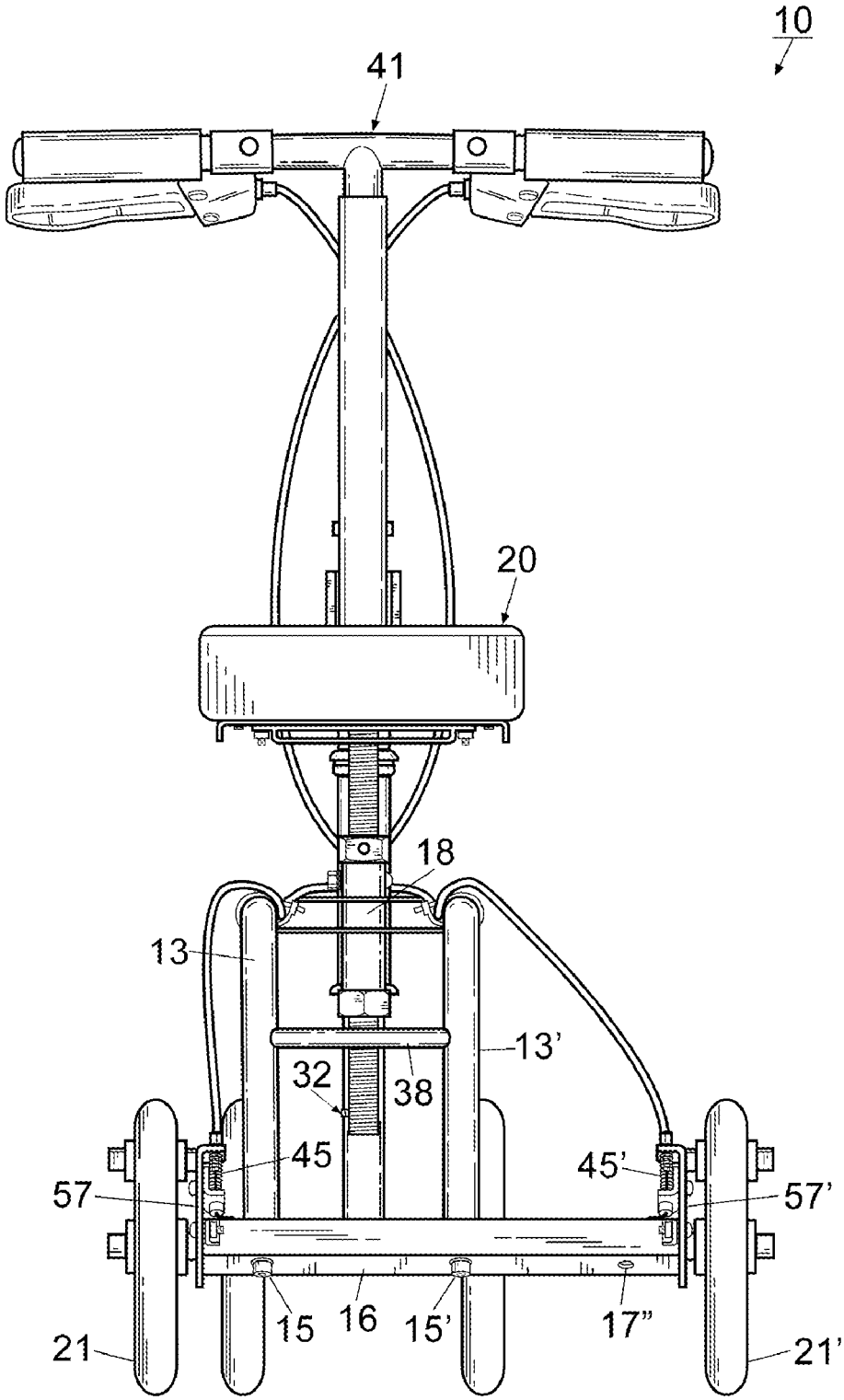
FIG. 4 features a rear elevational view of the scooter as shown in FIG. 1.
Figure 9:
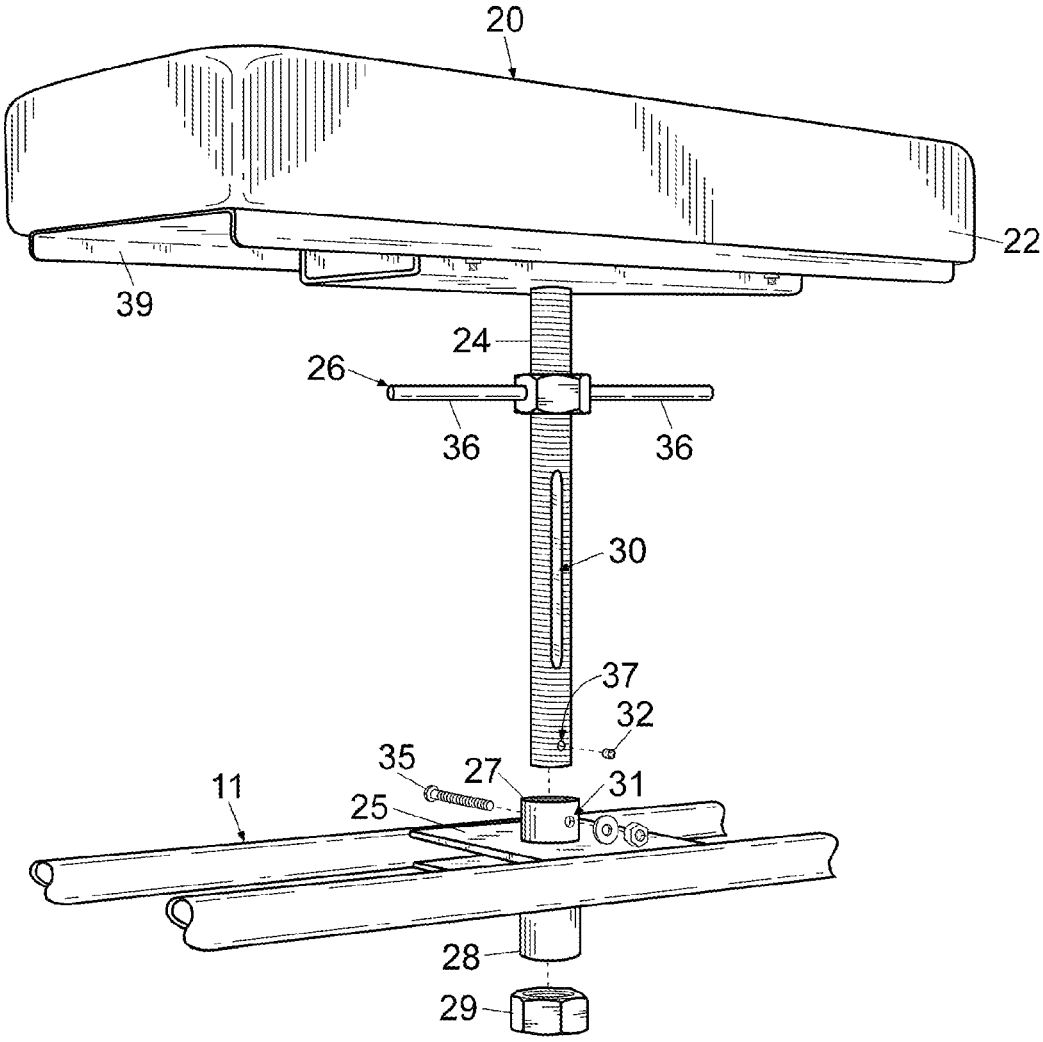
FIG. 9 illustrates in somewhat partial, exploded fashion the knee support and frame.

As illustrated in FIG. 9 knee support 20 includes vinyl covered polyurethane cushion 22 affixed to cushion brace 39 having threaded shaft 24 centrally rigidly affixed thereto for attachment to frame 11. As seen for example in FIGS. 2, 3 and 6 cushion brace 39 extends almost the full length and width of cushion 22 to provide rigid support therebeneath. Threaded shaft 24 includes vertical slot 30 therein and threadably receives winged locking nut 26 and passes through upper brace collar 27 and lower brace collar 28 of shaft collar 18 (FIG. 4) and threadably receives locking nut 29. Shaft collar 18 is a hollow smooth cylindrical tube sized to allow threaded shaft 24 to slide therethrough for easily adjusting the height of knee support 20. Shaft collar 18 is rigidly affixed such as by welding to frame brace 25 which is rigidly affixed to U-shaped frame 11 also by welding or the like. As seen in FIG. 4, frame brace 25 consists of upper and lower brace plates for rigidly maintaining and affixing knee support 20 with frame 11. Winged locking nut 26 is threaded and includes wings 36 for easy grip while tightening or loosening locking nut 26 against upper brace collar 27 whereas threaded locking nut 29 is tightenable against lower brace collar 28. Wings 36 are cylindrical rods extending horizontally for easily grasping and rotating for locking the position of knee support 20 after height adjustment.

Threaded shaft 24 of knee support 20 includes vertical slot 30 which is coincidentally aligned with opposing openings 31, 31' (31' not shown) in upper brace collar 27. Threaded bolt 35 is passed successively through upper brace collar opening 31'(not shown), slot 30 of shaft 24 and upper brace collar opening 31 after which a conventional washer and nut are tightened thereon. For additional security allen set screw 32 is received within opening 37 proximate the bottom of threaded shaft 24 as seen in FIG. 9 and extends slightly from threaded shaft 24 as seen in FIG. 4 to "catch" locking nut 29 should locking nut 29 inadvertently loosen and spiral downwardly from its intended position. Set screw 32 may extend about 0.125 inches (0.32 cm) from threaded shaft 24 when in place.

Threaded bolt 35 maintained within slot 30 of shaft 24 allows winged locking nut 26 and locking nut 29 to be loosened from respectively upper and lower brace collars 27, 28 whereby knee support 20 can be easily, slidably raised or lowered for height adjustment. The length of slot 30 and the positioning of threaded bolt 35 therein allows for vertical movement of shaft while hindering rotation to maintain alignment of knee support 20 with frame 11. Once the proper height is selected winged locking nut 26 can be easily grasped and rotatably tightened against upper brace collar 27 whereby locking nut 29 can then be tightened against lower brace collar 28.

Figure 5:
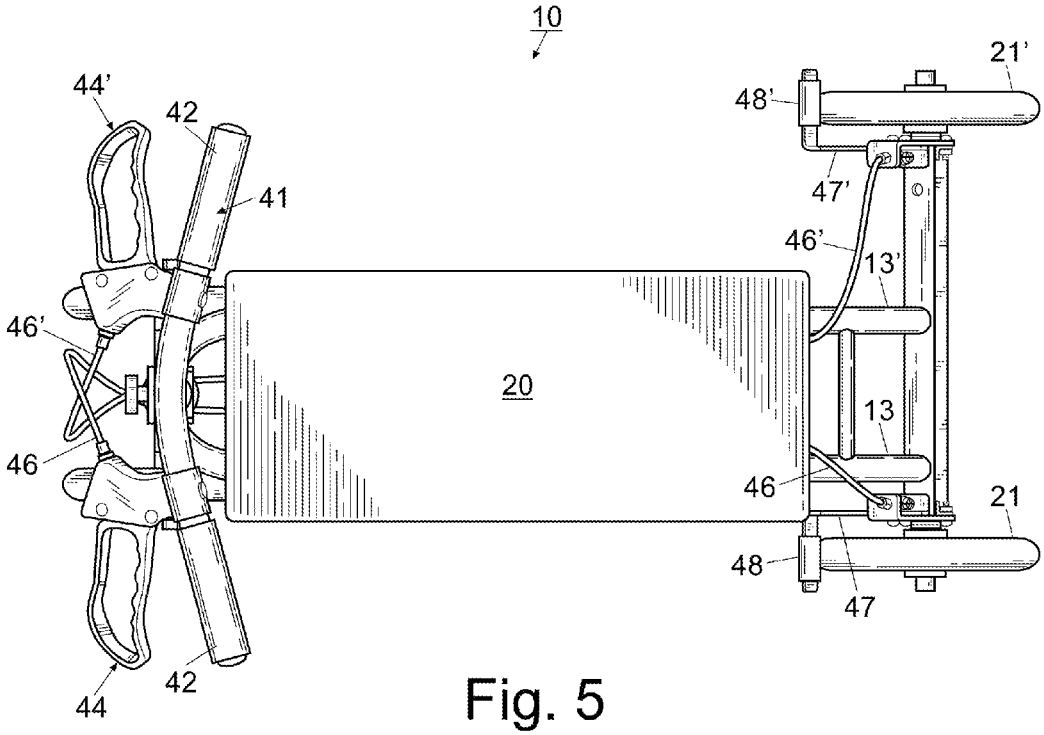
FIG. 5 illustrates a top plan view of the scooter as shown in FIG. 1.
Figure 6:
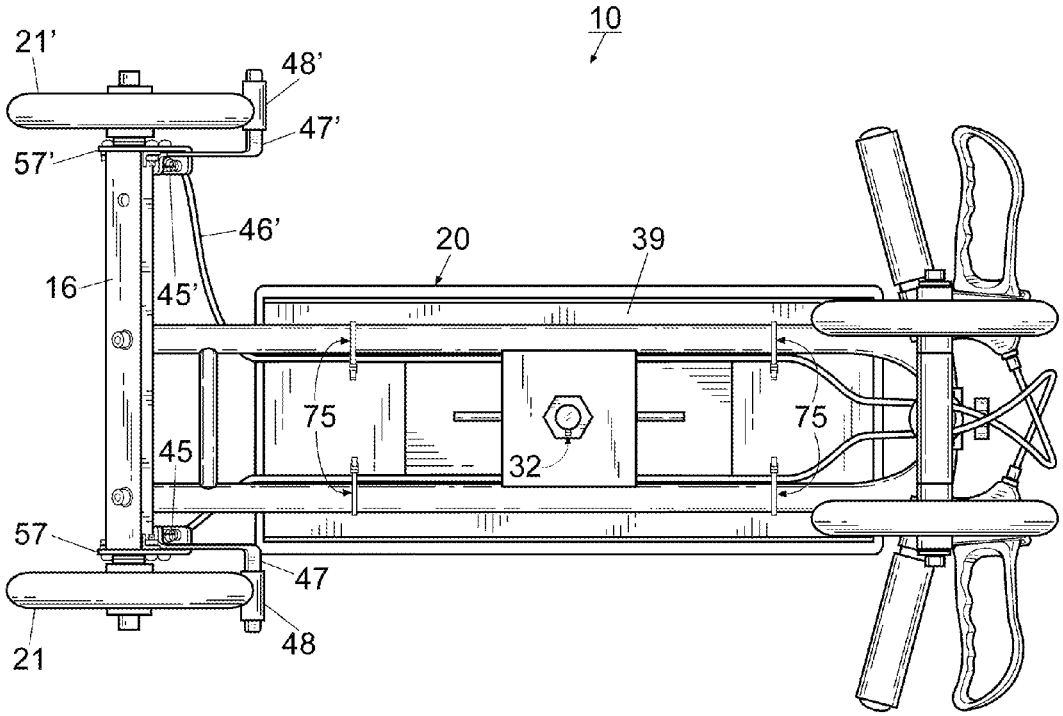
FIG. 6 depicts a bottom plan view of the scooter as shown in FIG. 1.
Figure 10:
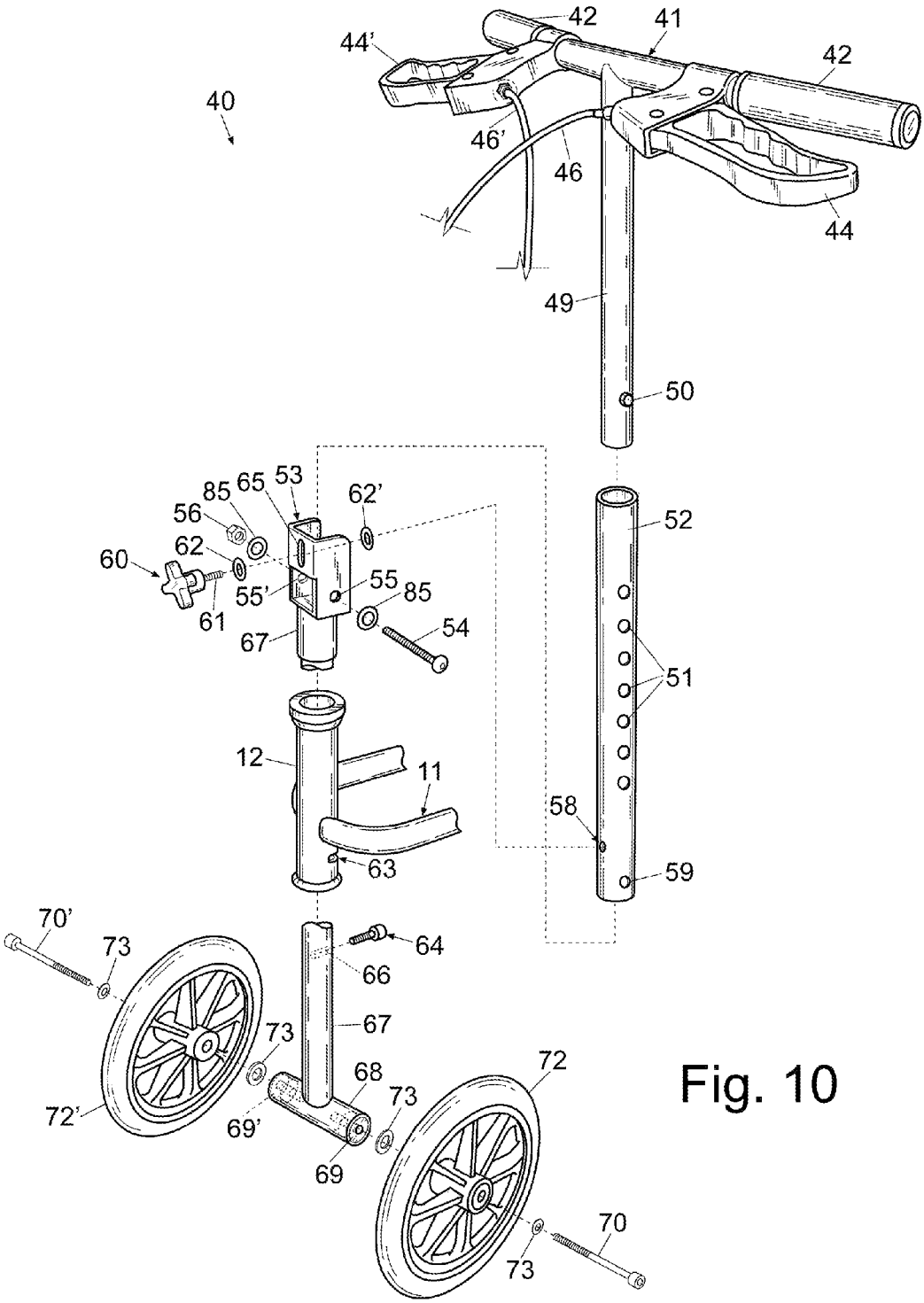
FIG. 10 shows an exploded view of the steering assembly and front axle.

Steering assembly 40 as shown in FIG. 10 includes handle bar 41 having a conventional C-shaped curvature as also seen in FIG. 5 with standard grips 42 and hand brakes 44, 44' which are conventional cable operated brakes with a locking feature when the lever is pushed forward into a detent position. Rear wheel brake 44 is spring loaded having cable 46 affixed to brake arm 47 with brake pad 48 which, when applied engages wheel 21 as also shown in FIGS. 6 and 8. Rear wheel brake 44' includes spring loaded brake cable 46' (FIG. 5), brake arm 47' and brake pad 48' and operates in the same manner as rear wheel brake 44, which is a standard bicycle wheel brake. Brake cables 46, 46' extend from hand brakes 44, 44' along steering assembly 40 and frame 11 to rear axle 16 and are secured by plastic ties 75 (FIG. 6) or the like thereto as required. Brake arms 47, 47' are loaded by springs 45, 45' respectively and are pivotally attached to brake housing 57, 57' respectively as seen in FIGS. 4, 6 and 8.

Handle bar 41 as shown in FIG. 10 includes cylindrical extension 49 affixed perpendicular thereto such as by welding or other means. Extension 49 is tubular and includes a pair of opposing, rounded spring loaded projections or studs 50 which are selectively engageable in opposing ports 51, 51' (51' shown in FIG. 2) on steering column tubular member 52 for height adjustment. Projections 50 would be simultaneously pushed inwards whereby handle bar 41 could be lifted or lowered depending on positioning and projections 50 would spring outwards in the next set of opposing ports 51, 51' and the step would be repeated as needed for selecting the proper height. Handle bar 41 is thus vertically adjustable so it can be selectively positioned along steering column member 52, for a particular user's convenience and comfort.

Steering column member 52 which folds contiguous knee support 20 for storage purposes is pivotally attached to clevis 53 by threaded axle 54 which passes through opposing openings 55, 55' in clevis 53 and opposing openings 59, 59' (59' not shown) in column member 52. Threaded axle 54 is positioned through a conventional washer 85, opening 55 in clevis 53, openings 59, 59' in column member 52, opening 55' in clevis 53 and through another conventional washer 85 and then tightened by axle nut 56 to thereby maintain steering column member 52 in clevis 53. Steering column member 52 is rotatable (foldable) about threaded axle 54 to allow downward pivoting of handle bar 41 against knee support 20 for storage and transportation. In order to prevent unwanted pivoting (folding) of steering column member 52 during normal use, clevis 53 includes front central slot 65 for receiving threaded shaft 61 of locking knob 60. Steering column member 52 includes front threaded opening 58 for threadably receiving shaft 61. Threaded shaft 61 is held on clevis 53 by retaining washers 62, 62' positioned on each side of slot 65 in clevis 53. Retaining washers 62, 62' prevent locking knob 60 from escaping slot 65 when handle bars 41 with steering column member 52 are folded or disengaged from clevis 53 as in a stored posture. When ready for use handle bars 41 are rotated upwardly and threaded shaft 61 is aligned with threaded opening 58 whereby locking knob 60 is manually rotated to tighten clevis 53 against column member 52.

Clevis 53 of steering assembly 40 as shown in FIG. 10 includes column rod 67 which passes through and is rotatable within sleeve 12 of frame 11 and is rigidly affixed such as welding to clevis 53. At the lowermost end of column rod 67 front axle 68 is perpendicularly, rigidly affixed thereto and includes opposing threaded inserts 69, 69'. Threaded axles 70, 70' are threadably engaged respectively with threaded inserts 69, 69' to retain respectively conventional front wheels 72, 72' thereon. Conventional washers 73 also shown in FIG. 10 are utilized on each side of front wheels 72, 72' to insure smooth operation and rotation. To prevent over-steering and possible tipping over of scooter 10, wheels 72, 72' can be turned or steered in limited fashion approximately 60° (30° to the left and 30° to the right of center). The steering limitation is provided by groove 63 in combination with pin 64 as for example, seen in FIGS. 1, 2, 8 and 10. Pin 64 includes an enlarged head and passes through groove 63 and is threaded into opening 66 on shaft 67 (FIG. 10). Thus, as scooter 10 is steered pin 64 remains in groove 63 and limits rotation of steering assembly 40 to about 60° rotation (about 30° in either direction) to allow wheels 72, 72' to sufficiently turn, but yet limits the range of turning to provide safety to user 23 (FIGS. 7A and 7B).

The method of operation of knee scooter 10 includes pivoting steering assembly 40 upwards whereby lock knob 60 is tightened to lock steering assembly 40 in an upright position. The height of handle bars 41 is then selectively adjusted for the particular user by projections 50 positioned in ports 51 along column member 52. Likewise knee support 20 is vertically adjusted by the rotation of winged locking nut 26 and lower locking nut 29 whereby knee support 20 can be slidably raised or lowered to accommodate the user's height and are then tightened in position against respectively upper brace collar 27 and lower brace collar 28 of shaft collar 18. Next, rear axle 16 is laterally adjusted by bolts 15, 15' in respectively either channels 17', 17 or 17, 17", depending on whether the user prefers to support his right or left knee, and propel scooter 10 with the other leg such as seen in FIGS. 7A and 7B. Knee scooter 10 is then ready for use. After use, handle bar 41 of steering assembly 40 can be lowered by turning knob 60 to withdraw shaft 61 from column member 52. Scooter 10 is then ready for storage or non-use.

The illustrations and examples provided herein are for explanatory purposes and are not intended to limit the scope of the appended claims.

I claim:

1. A knee scooter comprising: a frame, said frame comprising a horizontally oriented U-shaped tubular member, an adjustable knee rest, said knee rest mounted on said frame, a steering assembly, said steering assembly attached to said U-shaped tubular member, a front wheel, said front wheel attached to said steering assembly, a wide rear axle, said rear axle joined to said frame in opposing relation to said steering assembly, said frame laterally adjustable along said rear axle to accommodate supporting either a right knee or a left knee of a user.

2. The knee scooter of claim 1 further comprising a brake system, a rear wheel, said rear wheel attached to said rear axle, said brake system affixed to said rear wheel.

3. The knee scooter of claim 1 wherein in said frame further comprises a sleeve, said steering assembly further comprises a steering column, a column rod, said column rod rotatably mounted in said sleeve, said column rod attached to said steering column, said column rod defining an opening, said sleeve defining a groove, a pin, said pin positioned through said groove and into said column rod opening to limit the rotation of said column rod.

4. The knee scooter of claim 3 further comprising a front axle, said front wheel mounted on said front axle.

5. The knee scooter of claim 1 wherein said frame defines a pair of ends, each of said pair of frame ends adjustably connected to said rear axle.

6. The knee scooter of claim 5 wherein each of said pair of frame ends comprise a threaded insert, a pair of threaded members, and said rear axle defining a multiplicity of openings for receiving said pair of threaded members.

7. A scooter for an infirm user comprising: an elongated frame, said frame comprising a horizontally oriented U-shaped tubular member, a steering assembly, a rear axle, said frame attached at one end to said steering assembly and at the other end to said rear axle, said rear axle laterally adjustably connected to said frame to accommodate either a right or left knee of the user.

8. The scooter of claim 6 wherein said horizontally oriented U-shaped tubular member is parallel to said knee rest.

9. A method of propelling a knee scooter comprising the steps of:

a) providing a scooter having a frame with a sleeve and a horizontally oriented U-shaped tubular member, a shiftable rear axle with wheels attached to the frame wherein the rear axle can be adjusted on the frame for either right leg or left leg propulsion, a steering assembly and a front wheel attached to the frame, an adjustable knee rest affixed to the frame between the steering assembly and the rear axle;

b) adjusting the rear axle for either left leg or right leg propulsion;

c) placing a knee of one leg on the knee rest; and d) propelling the scooter with the other leg.

10. The method of claim 9 wherein providing a scooter comprises the step of providing a scooter having a brake system.

11. The method of claim 9 wherein adjusting the rear axle comprises the step of adjusting the rear axle for right leg propulsion.

12. The method of claim 9 wherein adjusting the rear axle comprises the step of adjusting the rear axle for left leg propulsion.

13. The method of claim 9 wherein adjusting the rear axle comprises the step of adjusting the rear axle laterally of the frame.

14. The method of claim 9 wherein providing a scooter comprises the step of providing a scooter having a steering assembly with a clevis.

15. The method of claim 14 further comprising the step of releasing the steering assembly from the clevis to allow the steering assembly to pivot.

16. The method of claim 9 wherein providing a scooter comprises the step of providing a scooter with a steering assembly having a rotatable column rod mounted within the sleeve of the frame and attached to a steering column, the sleeve defining a groove and the column rod defining an opening with a pin positioned through the sleeve groove and into the column rod opening to limit the rotation of the column rod.

17. The method of claim 16 wherein propelling the scooter comprises the step of limiting the rotation of the column rod.

* * * * *